US007026598B1

(12) United States Patent
Schwade et al.

(10) Patent No.: US 7,026,598 B1
(45) Date of Patent: Apr. 11, 2006

(54) VECTOR-BASED TARGETING CONTROL FOR A WATER CANNON

(75) Inventors: Hans Schwade, Atlanta, GA (US); M. Ishaq Jameel, Lawrenceville, GA (US)

(73) Assignee: Clyde Bergemann, Inc., Atlanta, GA (US)

( * ) Notice: Subject to any disclaimer, the term of this patent is extended or adjusted under 35 U.S.C. 154(b) by 662 days.

(21) Appl. No.: 10/078,983

(22) Filed: Feb. 20, 2002

(51) Int. Cl.
*G06M 7/00* (2006.01)
*F28G 3/00* (2006.01)
*B08B 9/00* (2006.01)

(52) U.S. Cl. ..... 250/221; 122/379; 134/18; 134/24; 134/34; 134/22.1; 134/22.11; 134/22.12; 134/22.18

(58) Field of Classification Search ..... 250/231.13, 250/231.14, 231.18, 221, 216, 221.1; 134/18, 134/42, 172, 24, 34, 22.1, 22.11, 22.12, 22.18; 122/379, 390, 391, 392, 396; 15/316.1, 317, 15/318–318.1; 239/750–754
See application file for complete search history.

(56) References Cited

U.S. PATENT DOCUMENTS

| | | | | |
|---|---|---|---|---|
| 3,941,987 A | | 3/1976 | Tack, Jr. | 235/151.11 |
| 4,083,135 A | | 4/1978 | Van den Brink et al. | 37/58 |
| 4,097,072 A | | 6/1978 | Van Heijst | 285/114 |
| 4,159,660 A | | 7/1979 | Buckley et al. | 82/3 |
| 4,254,521 A | | 3/1981 | Papmahl | 9/8 P |
| 4,487,436 A | | 12/1984 | Mares et al. | 285/228 |
| 4,499,436 A | | 2/1985 | Grib | 331/116 M |
| 4,509,002 A | | 4/1985 | Hollis, Jr. | 318/687 |
| 4,514,814 A | | 4/1985 | Evans | 364/474 |
| 4,644,188 A | | 2/1987 | Grib | 307/363 |
| 4,832,902 A | | 5/1989 | Kaufmann et al. | 376/268 |
| 5,503,115 A | | 4/1996 | Franzke et al. | 122/390 |
| 5,882,430 A | | 3/1999 | Kleye et al. | 134/18 |
| 5,925,193 A | | 7/1999 | Bude et al. | |
| 6,035,811 A | | 3/2000 | Bude et al. | |
| 6,119,955 A | * | 9/2000 | Starr | 239/11 |
| 6,283,069 B1 | | 9/2001 | Bude et al. | |
| 6,325,025 B1 | | 12/2001 | Perrone | |
| 6,425,352 B1 | | 7/2002 | Perrone | |
| 6,453,916 B1 | * | 9/2002 | Tran et al. | 134/58 R |
| 6,581,549 B1 | | 6/2003 | Stewart et al. | |
| 6,655,397 B1 | | 12/2003 | Brown et al. | |
| 2002/0078982 A1 | | 6/2002 | Ackerman et al. | |

FOREIGN PATENT DOCUMENTS

DE 145476 11/2003

OTHER PUBLICATIONS

HydroJet Boiler Cleaning System Announcement, Jan. 25, 2002.

HydroJet Technology, paper presented by Clint Brown, dated Aug. 2001.

5 undated photographs showing components of HydroJet cleaning system available from Diamond Power International, Inc.

* cited by examiner

*Primary Examiner*—David Porta
*Assistant Examiner*—Suezu Ellis
(74) *Attorney, Agent, or Firm*—Womble Carlyle Sandridge & Rice, PLLC

(57) ABSTRACT

A method for controlling the positioning of a stream of pressurized fluid against a surface zone of a stream generator to clean contaminants. The coordinates of a plurality of points of the surface zone to be cleaned are first determined. The coordinates are measured with respect to a fixed coordinate system with origin point at the location where the lance water cannon penetrates the cannon wall of the steam generator. The determined boundary points are converted into corresponding angles with respect to the horizontal plane and the cannon wall. These angles are then used directly to control the position of the lance with respect to the fixed coordinate system. The stream of pressurized fluid is directed against the surface zone in a predetermined pattern by monitoring and controlling the angle of the lance through axial resolvers.

16 Claims, 3 Drawing Sheets

VECTOR-BASED TARGETING CONTROL FOR A WATER CANNON

BACKGROUND OF THE INVENTION

The present invention is generally related to steam generators with lance type water cannons for cleaning heat transfer surfaces. More particularly, the present invention is directed to a method and system for controlling the positioning of the water cannon lance by measuring the angular displacements of the lance with respect to the wall on which the water cannon is mounted.

Large steam generators such as boilers have a combustion chamber and heat transfer surfaces on which soot and ash deposits build up as a result of the combustion process. The soot and ash buildup form a contamination layer on the heat transfer surfaces that reduces the heat exchange efficiency of the boiler. Some of the negative impacts of the thermal efficiency of these boilers are: (1) added fuel consumption in order to maintain the proper steam conditions that are required by the downstream processes; and (2) an increase in boiler flue gas temperature leading to increased fouling and plugging of the gas passages requiring the boiler to be taken off line to be cleaned.

In order to combat the buildup of ash, boilers are fitted with automatic cleaning devices known as soot blowers. There are many types of soot blowers based on boiler design as well as the area of the boiler that needs to be cleaned. In the case of boilers burning fossil fuels such as coal or heavy oil, there also is a need to clean the walls of the boiler in the area known as the lower furnace or hearth.

In this area of the boiler, the walls are comprised of tubes that are positioned side by side to form a box type shape. Fuel such as coal or oil is introduced into the cavity of this box (hearth) where it is burned. High pressure water flows through the inside of the tubes and is used to absorb the heat. In doing so, the water eventually picks up enough heat to be converted into steam.

Some of the residue of combustion adheres to the walls of the hearth inhibiting the transfer of heat. There are three methods in the prior art that have been used for cleaning the furnace wall: (1) traditional soot (wall) blowers containing a lance tube, and introduced through an opening in the boiler wall, eject steam/air back towards the wall; (2) water blowers that eject water back towards the wall; and (3) water cannons that eject water toward opposing or adjacent side walls.

Lance-type water cannons inserted through a front wall of the generator are used to direct a stream of fluid to clean the heat transfer surfaces. However, not all heat transfer surfaces develop an ash buildup at the same rate. Ash can accumulate more in one corner than in another. Likewise, more contamination by ash and soot can occur in one zone of a generator wall than in another zone of the same wall because of temperature differentials during the combustion process. The temperatures in some zones are higher than in others. The zones in which contaminants such as ash and soot build up more quickly require more frequent cleaning in order to retain heat exchange efficiency of the steam generator. Often sensors are installed in the furnace walls that measure the temperature or heat flux in order to determine the cleanliness of the heating surface that the water cannon is intended to keep in a clean condition. The information provided by the sensors is used in a control system to determine whether and where the water cannon shall clean.

SUMMARY OF THE INVENTION

The present invention provides a more efficient method for controlling the blower used in cleaning the ash and soot contamination off the zones where the buildup is the worst. It does this by a process of determining the appropriate angles with respect to the horizontal and to the cannon wall that correspond to the X, Y, Z coordinates of the points that bound the zone to be cleaned. The angles are measured by angular resolvers positioned at a cardan joint supporting the water cannon lance at the blower end.

The present invention provides a technique that maps any location in space to the appropriate angles that relate to the inclination of the lance with respect to the horizontal as well as the cannon wall. The angle made with the horizontal is further corrected to account for the gravitational effects on the trajectory of the water jet. In some instances both angles may have to be not only corrected for gravity but also for the influence of gas side turbulence. In this case the turbulence in the ambient flue gas deflects the jet away from the intended target. Those two angles represent the feedback provided by the X and Y resolvers for the cannon. The X and Y resolvers are positioned at the cardan joint that attaches the water cannon to the lance tube. The prior art used methods, particularly encoders, for measuring displacements in the x and y directions that related the position in space to a position on the motion wall.

In one exemplary embodiment, a method for controlling the positioning of a stream of pressurized fluid against a surface zone of a steam generator to clean contaminants is provided. The coordinates of the boundary points of the surface zone (i.e., defined area of a wall of the steam generator) to be cleaned are first determined. The coordinates are measured with respect to a fixed coordinate system such as the Cartesian coordinate system with origin point at the location where the water cannon lance penetrates the cannon wall of the steam generator. The determined boundary points are converted into corresponding angles with respect to the horizontal plane and the cannon wall (i.e., the wall of the steam generator or boiler through which the water cannon lance penetrates. These angles can be used directly to control the position of the cannon, or they can be translated into corresponding points on a motion plane defined by the prior art encoders with respect to the fixed coordinate system. The stream of pressurized fluid is directed against the surface zone in a predetermined pattern by monitoring and controlling the angle of the lance.

DESCRIPTION OF THE DRAWINGS

The invention is better understood by reading the following detailed description of an exemplary embodiment in conjunction with the accompanying drawings.

DETAILED DESCRIPTION OF THE INVENTION

Figure 1:
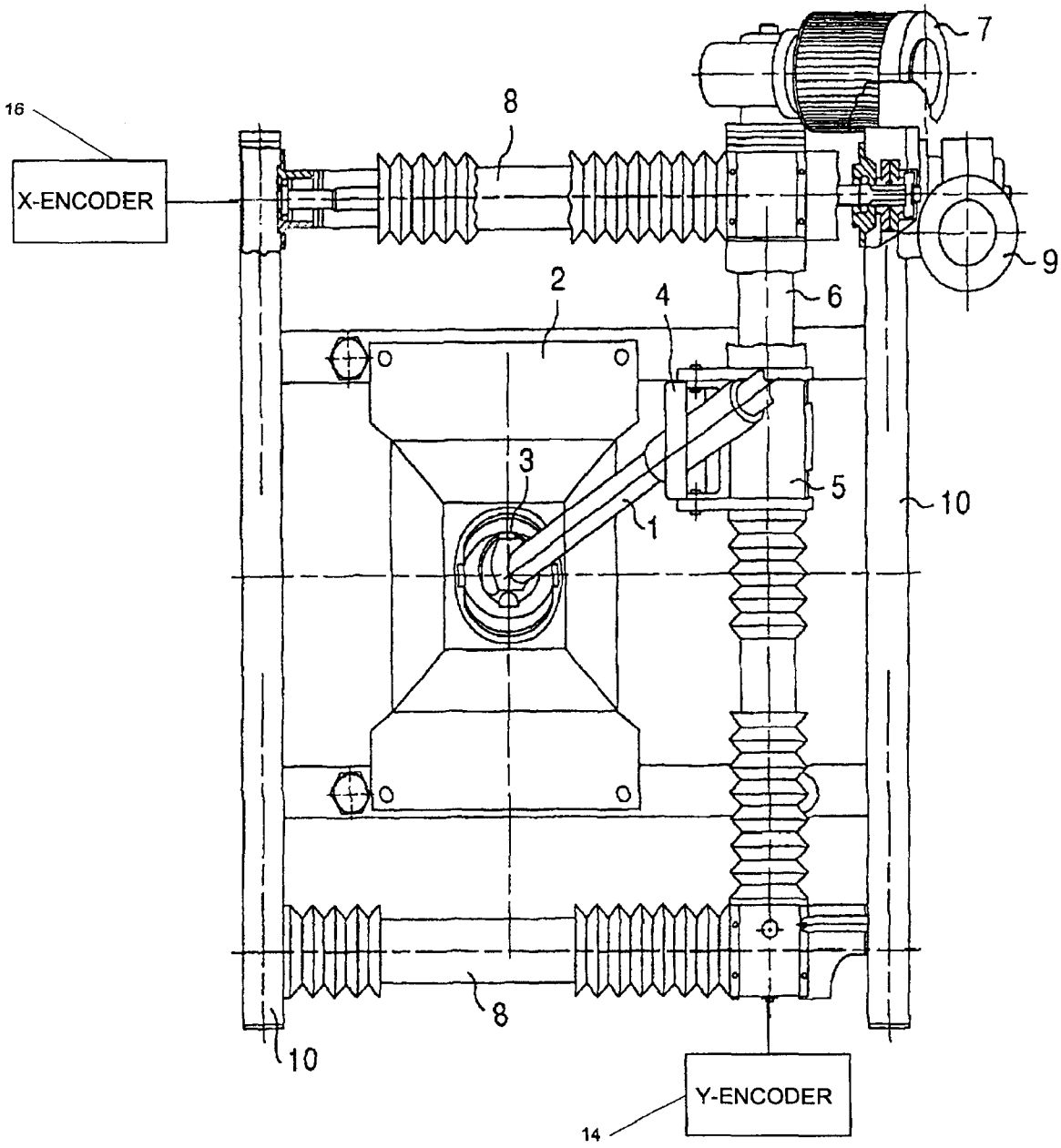
PRIOR ART FIG. 1
FIG. 1 illustrates a prior art example of a soot-removal blower in which encoders are used to determine distances traveled by a lance tube based on actuation of associated spindles.

The water cannon lance is mounted in a cardan-type (universal) joint on the cannon wall as illustrated in the prior art FIG. 1. This particular drawing is from U.S. Pat. No. 5,882,430, which is commonly-owned with the present invention. The disclosure of this patent, in its entirety, is incorporated by reference herein. This drawing will be used as a basis for explaining the novelty of the present invention, which uses axial resolvers instead of encoders. An advantage of measuring the angles directly by resolvers is that measuring angles actually provides the state of the lance tube, whereas using the encoders of the prior art, an indirect determination of the state of the lance tube was obtained by measuring the x and y displacements.

As shown in FIG. 1, lance 1 of the water lance blower is mounted to the opening in the steam generator wall via wall box 2 that, in turn, is attached to the wall of the combustion chamber. The lance 1 is secured in cover 2 by a universal joint 3. The other end of lance 1 slides axially in and out of second universal joint 4. The second universal joint 4 is attached to an alignment sleeve 5 that slides along a spindle 6. The spindle 6 is driven by braking motor 7. The ends of the spindle slide back and forth along two parallel spindles 8. Braking motor 9 drives one spindle 8 directly and the other spindle 8 by way of chain 10. The rotation of spindle 6 vertically displaces alignment sleeve 5 along with second universal joint 4. Lance 1 will sweep along a horizontal axis, and the jet leaving lance 1 will be shifted vertically. This vertical displacement is measured by Y-encoder 14 mounted on spindle 6. The rotation of parallel spindles 8 will similarly generate horizontal motion of spindle 6 and of the second universal joint 4 mounted thereon. Lance 1 will accordingly swing around a vertical axis, and the jet leaving lance 1 will move horizontally. This horizontal displacement is measured by X-encoder 16 mounted on one of the two spindles 8 as shown in FIG. 1.

Figure 2:
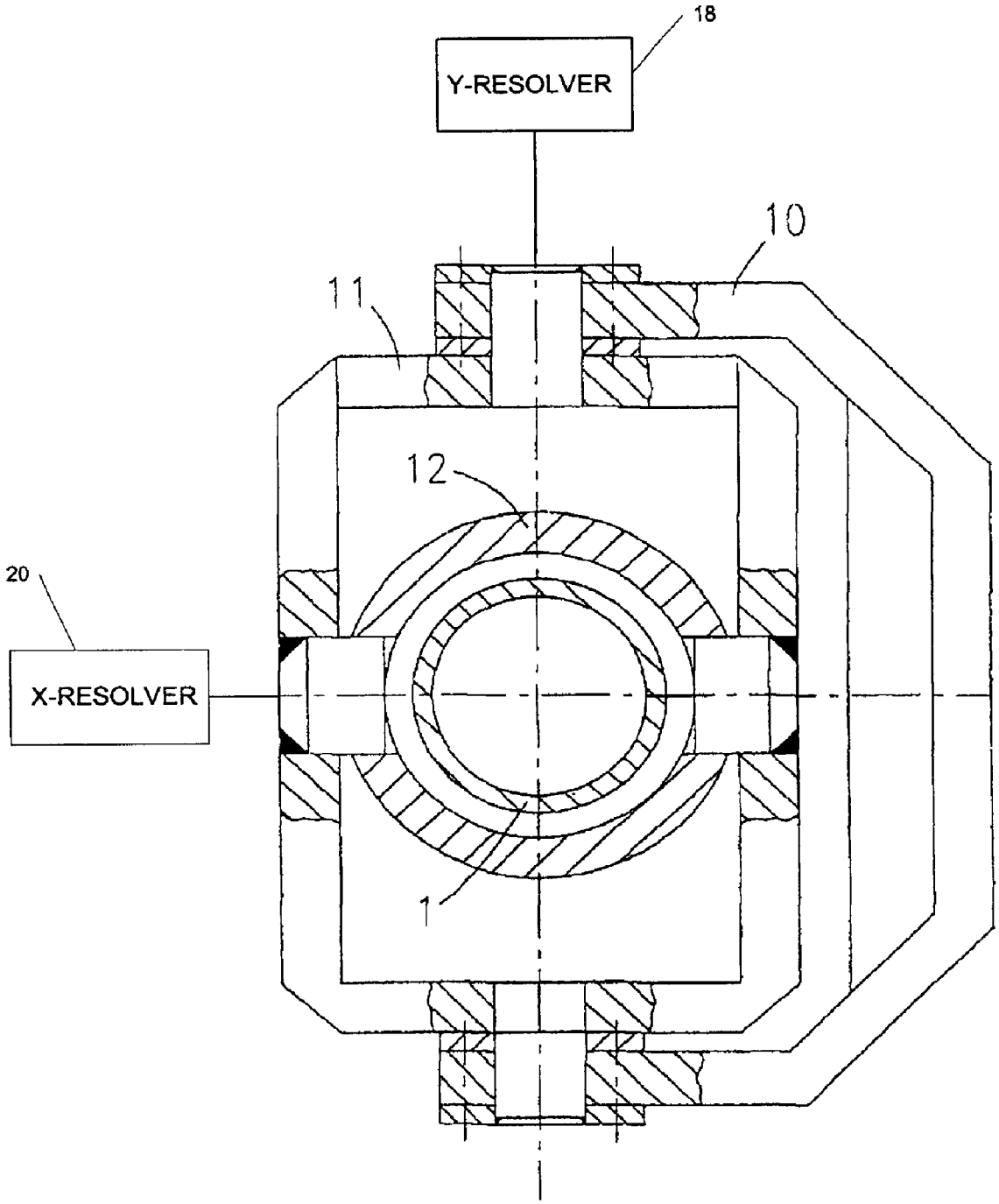
FIG. 2 illustrates the placement of resolvers to measure the angular rotation of the lance tube with respect to a pair of axes.

FIG. 2 shows a cross-sectional view of second universal joint 4 at the end of lance 1. The present invention provides X-resolver 20 and Y-resolver 18, which directly measure the angular rotation of the lance 1 about the horizontal and vertical axes, respectively. X-resolver 20 and Y-resolver 18 replace the X-encoder 16 and Y-encoder 14 of FIG. 1. The housing accommodation 10 on vertical spindle 6 supports a cardan-shaped cage 11. In its interior portion, the cage 11 can be designed as a sleeve 12 that holds the lance 1, in an axially shiftable manner.

Resolvers measure the angular rotation of the lance. The resolvers are positioned a fixed distance from the cannon wall and measure the angle of rotation of the lance with respect to the X-Y and X-Z planes, respectively. In directing the stream of fluid against the zone to be cleaned, various patterns can be developed to cover the zone. In one exemplary embodiment, a zone is covered by following a zigzag pattern from the left edge of the zone to right edge of the zone at the highest elevation of the top boundary points and then right edge to left edge at an angle depressed a fixed amount from the initial angle, etc. until the entire zone has been covered. Regions in a zone can be excluded such as, for example, the door of the boiler, by mapping out the boundary points of the door in X, Y, Z space.

Figure 3:
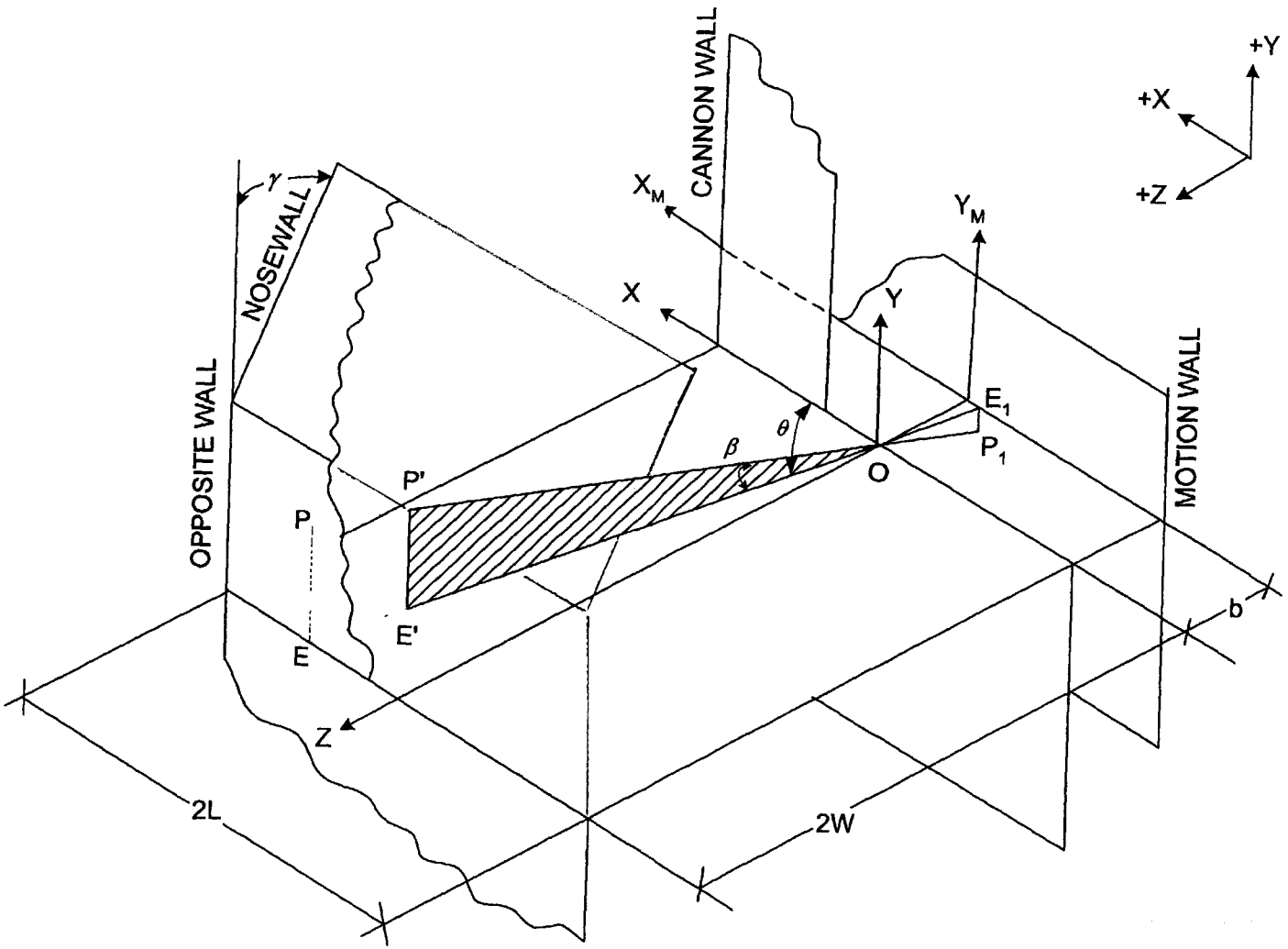
FIG. 3 illustrates an isometric sketch of a layout for a water cannon positioned on the cannon wall while aimed at a point in space.

FIG. 3 shows an isometric sketch of a layout for a cannon positioned at location O on the cannon wall while being aimed at some point P' in space. The cross section of the boiler is 2L×2W. The coordinates of the point P' are ($X_{p'}$, $Y_{p'}$, $Z_{p'}$). The angle that the lance makes with respect to the horizontal is β, while the angle it makes with respect to the cannon wall is θ. To compensate for the effects of gravity one would increase the value of β depending on the relative position of the target point in relation to the origin as well as the velocity of the jet at the nozzle exit. In addition to gravitational effects the trajectory of the jet can be influenced by the turbulence of the flue gas flow in the boiler. Further corrections to the inclination of the lance can be done by using the signals of the wall sensors as a feedback for the impingement location of the jet on the wall. If the effects of gravity and gas side turbulence were to be neglected, OP' represents the path of the jet between the cannon nozzle and point P'. Point P ($X_p$, $Y_p$, $Z_p$) represents the location where line OP' intersects with the opposite wall.

Also shown in the figure is an inclined wall representing part of the boiler nose. This wall is inclined at an angle γ with respect to the opposite wall. If necessary, point P' could be such that OP' never intersects the opposite wall, but instead intersects a point on either the inclined nose wall or one of the side walls of the boiler. If the inclined wall shown in the figure were facing downwards, it would represent a hopper wall.

The following represents the vector analysis for a boiler wall. Vector $\overline{OP}$ represent the line of sight (water jet) from the lance tip to point P on the opposite wall.

$$\overline{OP}=X_p\bar{i}+Y_p\bar{j}+Z_p\bar{k} \tag{1}$$

$\bar{i}$, $\bar{j}$, and $\bar{k}$ are the unit vectors, in the direction of the three axes X, Y and Z, respectively. Point E represents the location of the normal from point P to the horizontal X-Z plane. Therefore, vector $\overline{OE}$ is:

$$\overline{OE}=X_p\bar{i}+Z_p\bar{k} \tag{2}$$

Taking the dot product between these two vectors gives, $$\mathrm{Cos}\beta=\frac{\overline{OP}\cdot\overline{OE}}{|\overline{OP}||\overline{OE}|} \tag{3}$$

Substituting equations (1) and (2) in equation (3) provides:

$$\beta=\mathrm{ArcCos}\sqrt{\frac{X_p^2+Z_p^2}{X_p^2+Y_p^2+Z_p^2}} \tag{4}$$

In the front wall, $Z_p$=2W, the angle β represents measurements made by the Y-axis resolver for the water cannon.

In order to determine the angle θ measured between the plane OPE and the Y-Z plane, the dot product between vector $\overline{OE}$ and $\overline{OX}=\bar{k}$ is taken. The result is $$\mathrm{Cos}\theta=\frac{\overline{OE}\cdot\overline{OZ}}{|\overline{OE}|} \tag{5}$$

Substituting for $\overline{OE}$ and $\overline{OZ}$ in equation (5) gives the angle measured by the X-axis resolver for the water cannon.

$$\theta=\mathrm{ArcCos}\left(\frac{Z_P}{\sqrt{X_p^2+Z_p^2}}\right) \tag{6}$$

In the case of the front wall, $Z_p$=2W while for the side wall $X_p$=L.

The following represents the vector analysis for the motion plane. The motion plane of the cannon is a plane parallel to the cannon plane set back by a distance of 'b' on the Z-axis. The equation of the motion plane is:

$$Z_M=-b \tag{7}$$

The parametric form of vector $\overline{OP}$ is given by:

$$X=X_pt,\ Y=Y_pt \text{ and } Z=Z_pt \tag{8}$$

If $E_1(X_M, Y_M, Z_M)$ represents the point of intersection of the vector $\overline{OP}$ with the motion plane then, $Z_p t=-b$ or $t=-b/Z_p$. Therefore, $$X_M = X_P(-b/Z_P),\ Y_M = Y_P(-b/Z_P) \text{ and } Z_M = -b \tag{9}$$

In the case of the front wall $Z_p=2W$ . Substituting this value into the above expressions yields $$X_M / X_P = -b/2W \text{ and} \tag{10}$$

$$Y_M / Y_P = -b/2W \tag{11}$$

Consider a point P on the side wall where $Y_p=\pm L$ If Z' is the projection of point E' on the OZ axis then, $$\mathrm{Cot}\theta = \frac{Z_P}{X_P} = \pm\frac{Z_P}{L} \tag{12}$$

Substituting $Z_p$ from equation (12) in equation (9) provides:

$$\frac{X_M}{L} = -\frac{b}{L\mathrm{Cot}\theta} \tag{13}$$

and $$\frac{Y_M}{Y_P} = -\frac{b}{L\mathrm{Cot}\theta} \tag{14}$$

The angle θ has already been derived in equation (6).

As examples of the use of the invention for determining the angular rotation of the lance to direct a stream of fluid to a point in the steam generator, consider a boiler whose dimensions are 2L=150' and 2W=100'. A water cannon is placed on the front wall at an elevation 40' below the inclined surface of the nose. In the following examples, three cases are considered wherein a point P $(X_p, Y_p, Z_p)$ lies on the boiler rear wall, side wall and inclined surface of the nose, respectively. The examples determines the angles that represent the inclination of the lance with respect to the horizontal and the boiler wall so that the lance points in the direction of point P.

Case 1—Boiler Rear Wall

Let Point P lie on the boiler rear wall where $X_p=-50'$, $Y_p=25'$ and $Z_p=2W=100'$. Therefore the inclination of the lance tube β with respect to the X-Z plane is:

$$\beta = \mathrm{ArcCos}\sqrt{\frac{50^2+100^2}{50^2+25^2+100^2}} = 13°$$

The angle θ made by the lance tube and the Y-Z plane is:

$$\theta = \mathrm{ArcCos}\left(\frac{100}{\sqrt{50^2+100^2}}\right) = 27°$$

Case 2—Boiler Side Wall

Point P lies on the side wall where $X_p=-75'$, $Y_p=25'$ and $Z_p=90'$. Once again angles β and θ are calculated according to equations (4) and (6) to yield:

$$\beta = \sqrt{\frac{75^2+90^2}{75^2+25^2+90^2}} = 12° \text{ and,}$$

$$\theta = \mathrm{ArcCos}\left(\frac{90}{\sqrt{75^2+90^2}}\right) = 40°$$

Case 3—Boiler Nose

Consider a point P that lies on the lower inclined surface of the boiler nose. The coordinates for point P are as follows: $X_p=50'$, $Y_p=65'$, and $Z_p=92'$. Note that the boiler rear wall is at a distance 2W=100'. The inclinations of the lance, to the X-Z and Y-Z planes respectively, are:

$$\beta = \mathrm{ArcCos}\sqrt{\frac{50^2+92^2}{50^2+65^2+92^2}} = 32° \text{ and,}$$

$$\theta = \mathrm{ArcCos}\left(\frac{92}{\sqrt{50^2+92^2}}\right) = 29°$$

Those skilled in the art will appreciate that many modifications to the exemplary embodiments of the present invention are possible without departing from the spirit and scope of the present invention. In addition, it is possible to use some of the features of the present invention without the corresponding use of the other features. Accordingly, the foregoing description of the exemplary embodiments are provided for the purpose of illustrating principles of the present invention and not in limitation thereof, since the scope of the present invention is defined solely by the appended claims.

What is claimed is:

1. A method for directing a jet of pressurized fluid that is ejected from a pivoting lance tube of a water cannon towards a target point on a surface to be cleaned, comprising the steps of:

determining an angle that the lance tube has to be placed in with respect to at least one reference plane in order for the jet to hit the target point on the surface; and moving the lance tube to the determined angle.

2. The method for directing a jet of pressurized fluid of claim 1 further comprising the step of placing the lance tube in a sequence of new positions that correspond to a plurality of new target points by moving the lance tube into positions having at least one corresponding angle for each of the new target points.

3. The method for directing a jet of pressurized fluid of claim 2 further comprising the step of measuring the angle of the lance tube using a sensor attached to a pivoting joint holding and moving with the lance tube.

4. The method for directing a jet of pressurized fluid of claim 2 wherein the sensor is a resolver and provides an absolute position or angle information at all times instead of an incremental position or relative information.

5. The method for directing a jet of pressurized fluid of claim 2 comprising the steps of:

programming a logic controller with a cleaning sequence for the water cannon; and moving the lance tube into a plurality of positions corresponding to the programmed cleaning sequence.

6. The method for directing a jet of pressurized fluid of claim 5 wherein the logic controller is programmed to compensate for a droop of the jet of pressurized fluid over a distance between the lance tip and the target point as a result of gravitational forces.

7. The method for directing a jet of pressurized fluid of claim 5 wherein the logic controller is programmed to compensate for a deflection of the jet of pressurized fluid as a result of turbulence in the ambient gas stream by using the feedback from sensors mounted on the target wall.

8. The method for directing a jet of pressurized fluid of claim 1 further comprising determining a pair of angles that the lance tube has to be placed in with respect to a horizontal plane and a cannon wall.

9. A method for controlling the position of a water cannon jet that is ejected from a lance tube that has one end attached at a boiler wall while the other end is attached to a water cannon in a joint, with the water cannon mounted at a fixed distance from the boiler wall to deliver a stream of pressurized fluid against a surface of the boiler to be cleaned of contaminants, comprising the steps of:

determining the coordinates of a target point in space with respect to a fixed coordinate system;

transforming the coordinates of the target point to an angle that the lance tube makes with at least one reference plane; and monitoring an angular rotation of the lance tube from an initial position to the target position.

10. The method for controlling the position of the water cannon jet of claim 9 further comprising the step of directly measuring the angle of the lance tube with a sensor attached to a joint that connects the lance tube to the water cannon.

11. The method for controlling the position of a water cannon jet of claim 9 wherein a pair of angles are determined and a horizontal plane and a cannon wall are used as reference planes.

12. The method for controlling the position of a water cannon jet of claim 9 wherein the joint attaching the lance at the water cannon is a cardan style joint fitted with an angular sensor that measures an angular rotation of the lance with respect to a horizontal plane.

13. The method for controlling the position of a water cannon jet of claim 12 wherein the angular sensor determines an angular rotation of the lance about an X-axis.

14. The method for controlling the position of a water cannon jet of claim 9 wherein the joint attaching the lance at the water cannon is a cardan style joint fitted with an angular sensor that measures an angular rotation of the lance with respect to a cannon wall.

15. The method for controlling the position of a water cannon jet of claim 14 wherein the angular sensor determines an angular rotation of the lance about an Y-axis.

16. The method for controlling the positioning of a water cannon jet of claim 9 wherein an inclination of the water cannon lance is determined by a plurality of angular sensors positioned in a cardan joint supporting an end of the water cannon lance that is located outside the cannon wall.

* * * * *